US011052506B2

(12) United States Patent
Nishimura

(10) Patent No.: US 11,052,506 B2
(45) Date of Patent: Jul. 6, 2021

(54) CARRIER RING, GRINDING DEVICE, AND GRINDING METHOD

(71) Applicant: SUMCO CORPORATION, Tokyo (JP)

(72) Inventor: Yoshinobu Nishimura, Tokyo (JP)

(73) Assignee: SUMCO CORPORATION, Tokyo (JP)

( * ) Notice: Subject to any disclaimer, the term of this patent is extended or adjusted under 35 U.S.C. 154(b) by 375 days.

(21) Appl. No.: 15/766,484

(22) PCT Filed: Oct. 5, 2016

(86) PCT No.: PCT/JP2016/079659
§ 371 (c)(1),
(2) Date: Apr. 6, 2018

(87) PCT Pub. No.: WO2017/061486
PCT Pub. Date: Apr. 13, 2017

(65) Prior Publication Data

US 2019/0084122 A1 Mar. 21, 2019

(30) Foreign Application Priority Data

Oct. 9, 2015 (JP) ..... JP2015-201489

(51) Int. Cl.
*B24B 37/08* (2012.01)
*B24B 37/28* (2012.01)
(Continued)

(52) U.S. Cl.
CPC ..... *B24B 37/32* (2013.01); *B24B 7/17* (2013.01); *B24B 7/228* (2013.01); *B24B 37/042* (2013.01);
(Continued)

(58) Field of Classification Search
CPC ..... B24B 7/17; B24B 7/228; B24B 37/042; B24B 37/08; B24B 37/28; B24B 37/32
(Continued)

(56) References Cited

U.S. PATENT DOCUMENTS 4,805,348 A * 2/1989 Arai ..... B24B 37/28 451/269
6,036,585 A 3/2000 Nishi et al.
(Continued)

FOREIGN PATENT DOCUMENTS

CN 1145531 3/1997
CN 102026774 4/2011
(Continued)

OTHER PUBLICATIONS

Office Action issued in China Counterpart Patent Appl. No. 201680058946.0, dated Jul. 1, 2019, along with an English translation thereof.
(Continued)

*Primary Examiner* — Eileen P Morgan
(74) *Attorney, Agent, or Firm* — Greenblum & Bernstein, P.L.C.

(57) ABSTRACT

A double-head grinding machine includes a disc-shaped carrier ring having a support hole for supporting a silicon wafer, a rotation mechanism rotating the carrier ring around a center of the carrier ring, and a grinding wheel including a grinding stone for grinding the silicon wafer. The support hole is circular and has a center eccentric to the center of the carrier ring.

2 Claims, 4 Drawing Sheets

(51) Int. Cl.

| | |
|---|---|
| ***B24B 37/32*** | (2012.01) |
| ***B24B 7/17*** | (2006.01) |
| ***B24B 7/22*** | (2006.01) |
| ***B24B 37/04*** | (2012.01) |
| ***B24B 37/34*** | (2012.01) |

(52) U.S. Cl.
CPC ..... *B24B 37/28* (2013.01); *B24B 37/34* (2013.01); *B24B 37/08* (2013.01)

(58) Field of Classification Search
USPC ..... 451/41, 57, 58, 262, 268, 269
See application file for complete search history.

(56) References Cited

U.S. PATENT DOCUMENTS

| | | | | |
|---|---|---|---|---|
| 6,220,931 | B1 | 4/2001 | Nishi et al. | |
| 8,137,157 | B2 * | 3/2012 | Fletcher | B24B 37/28 451/269 |
| 8,414,360 | B2 * | 4/2013 | Lee | B24B 37/28 451/262 |
| 8,562,390 | B2 | 10/2013 | Kobayashi et al. | |
| 9,266,215 | B2 * | 2/2016 | Sato | H01L 21/02024 |
| 9,289,876 | B2 * | 3/2016 | Ogata | B24B 37/08 |
| 2002/0115387 | A1 * | 8/2002 | Wenski | B24B 37/08 451/41 |
| 2004/0224522 | A1 * | 11/2004 | Bex | B24B 37/28 438/692 |
| 2005/0124264 | A1 * | 6/2005 | Tominaga | B24B 37/08 451/41 |
| 2005/0159089 | A1 | 7/2005 | Horiguchi et al. | |
| 2006/0128276 | A1 | 6/2006 | Horiguchi et al. | |
| 2008/0166952 | A1 * | 7/2008 | Ueno | B24B 37/28 451/41 |
| 2008/0233840 | A1 * | 9/2008 | Pietsch | B24B 37/28 451/41 |
| 2009/0305615 | A1 * | 12/2009 | Uchiyama | B24B 37/28 451/57 |
| 2011/0045748 | A1 * | 2/2011 | Lee | B24B 37/28 451/65 |
| 2012/0156970 | A1 * | 6/2012 | Pietsch | B24B 37/08 451/41 |
| 2013/0337723 | A1 * | 12/2013 | Tanimoto | B24B 49/14 451/6 |
| 2015/0165585 | A1 * | 6/2015 | Ogata | B24B 37/08 451/5 |
| 2017/0312878 | A1 * | 11/2017 | Yasuda | B24B 37/08 |

FOREIGN PATENT DOCUMENTS

| | | | |
|---|---|---|---|
| CN | 102543709 | | 7/2012 |
| CN | 102473624 | | 12/2014 |
| JP | 3-221368 | A | 9/1991 |
| JP | 7-1306 | | 1/1995 |
| JP | 2000-288882 | | 10/2000 |
| JP | 2001-310247 | | 11/2001 |
| JP | 3234881 | | 12/2001 |
| JP | 2003-124167 | | 4/2003 |
| JP | 2005-205585 | A | 8/2005 |
| JP | 2006-159383 | A | 6/2006 |
| JP | 2009-279704 | | 12/2009 |
| JP | 2013-502719 | | 1/2013 |
| JP | 2013-215813 | | 10/2013 |
| JP | 5411739 | | 2/2014 |
| TW | 434100 | | 5/2001 |
| TW | 2013-31315 | | 8/2013 |
| TW | 2014-08434 | | 3/2014 |
| TW | 2014-40954 | | 11/2014 |
| WO | WO-2015136840 | A1 * | 9/2015 ..... B24B 37/08 |

OTHER PUBLICATIONS

Notice of Reason(s) for Rejection in Japan Patent Application No. JP 2015-201489, dated Feb. 4, 2020.
Office Action issued in Japan Counterpart Patent Appl. No. 2015-201489, dated Oct. 8, 2019, along with an English translation thereof.
JP Official Action issed in JP Appl. No. 2015-201489, dated Feb. 12, 2019.
International Search report issued in PCT/JP2016/079659, dated Nov. 22, 2016.
Office Action issued in Taiwan Counterpart Patent Appl. No. 105127028, dated Aug. 17, 2017, along with an english translation thereof.
English translation of International Preliminary Report on Patentability issued in PCT/JP2016/079659, dated Apr. 10, 2018.
China Official Action received in Chinese patent application No. 201680058946.0, dated Jun. 23, 2020 and English translation thereof.

* cited by examiner

CARRIER RING, GRINDING DEVICE, AND GRINDING METHOD

TECHNICAL FIELD

The present invention relates to a carrier ring, a grinding machine and a grinding method.

BACKGROUND ART

Double-side grinding of a silicon wafer is usually performed using a double-head grinding machine in the following procedure.

First, the silicon wafer is supported in a support hole of a carrier ring. In supporting the silicon wafer, a notch provided to the silicon wafer is engaged with a projection projecting into the support hole, thus allowing the silicon wafer to rotate in conjunction with the carrier ring. Further, the silicon wafer is supported such that a center of the silicon wafer is aligned with a center of the carrier ring. Subsequently, the silicon wafer is ground by pressing two rotating grinding wheels against both surfaces of the silicon wafer while supplying a grinding fluid into the grinding wheels, and rotating the carrier ring around the center of the carrier ring.

Unfortunately, the silicon wafer subjected to the double-side grinding frequently has a surface waviness, which is herein referred to as nanotopography. Accordingly, a technique for reducing serious nanotopography to improve the flatness of a silicon wafer has been discussed (see, for instance, Patent Literature 1). It should be noted that nanotopography is defined herein as "a waviness in nanometers that is present in a millimeter cycle on a silicon wafer that is laid without being sucked or while being slightly sucked."

Patent Literature 1 teaches a mechanism of causing serious nanotopography as follows. For the above double-side grinding, the silicon wafer is provided with the single notch and the carrier ring is provided with the single projection, so that a stress due to the rotation of the carrier ring concentrates on the notch and the projection. The silicon wafer is thus likely to deform near the notch. If the silicon wafer with the deformation near the notch is subjected to the double-side grinding, the silicon wafer has serious nanotopography.

According to a technique for reducing such serious nanotopography disclosed in Patent Literature 1, another projection is provided to the carrier ring in addition to the typical projection, whereas another notch for supporting is provided to the silicon wafer in addition to the typical notch, and each of the projections is engaged with the corresponding one of the notches in subjecting the silicon wafer to the double-side grinding to disperse the stress due to the rotation of the carrier ring.

Further, the prevent inventor has found that no serious nanotopography occurs in a silicon wafer subjected to the double-side grinding using a carrier ring having just been put into use, whereas serious nanotopography is likely to occur with an increase in the duration of use of the carrier ring, and has speculated the cause of such a phenomenon as follows.

The projection is inevitably ground as the silicon wafer is ground. An increase in the grinding amount of the projection causes warpage of the projection in a direction orthogonal to a surface of the silicon wafer being ground and, consequently, warpage of a portion of the silicon wafer near the notch in the same direction as the warpage of the projection.

If the silicon wafer with the warpage is subjected to the double-side grinding, the silicon wafer would have serious nanotopography.

Accordingly, as measures to reduce such serious nanotopography, the present inventor has set a limit on the duration of use of a carrier ring and replaced the carrier ring after the elapse of the limited duration of use.

CITATION LIST

Patent Literature(s)

Patent Literature 1: JP 2009-279704 A

SUMMARY OF THE INVENTION

Problem(s) to be Solved by the Invention

The technique disclosed in Patent Literature 1, however, necessitates a post-process for removing the notch for supporting provided to the silicon wafer, thus complicating the grinding process.

Further, the above method of setting a limit on the duration of use necessitates a large number of carrier rings, thus increasing costs.

An object of the invention is to provide a carrier ring, a grinding machine and a grinding method that are capable of improving the grinding quality of a workpiece without complicating a process and increasing costs.

Means for Solving the Problem(s)

According to an aspect of the invention, a disc-shaped carrier ring for grinding a workpiece with a circular contour is provided with a support hole for supporting the workpiece, the support hole having a center eccentric to a center of the carrier ring.

According to another aspect of the invention, a grinding machine configured to grind a workpiece with a circular contour includes: the carrier ring; a rotation mechanism configured to rotate the carrier ring around the center of the carrier ring; and a grinding stone for grinding the workpiece.

According to still another aspect of the invention, a grinding method for grinding a workpiece with a circular contour includes: supporting the workpiece in the support hole of the carrier ring such that a center of the workpiece is eccentric to the center of the carrier ring; rotating the carrier ring around the center of the carrier ring; and grinding the workpiece using a grinding stone.

For typical grinding, the carrier ring is rotated with the center of the workpiece being aligned with the center of the carrier ring. Such an arrangement does not cause the support hole to move with respect to the workpiece as seen from a ground-surface side, so that an inner circumferential surface of the support hole does not come into contact with an outer circumferential surface of the workpiece in theory, thus transferring no rotary driving force from the carrier ring to the workpiece. Accordingly, to transfer the rotary driving force from the carrier ring to the workpiece, a projection engageable with a notch of the workpiece has been necessarily provided to the carrier ring.

In contrast, according to the above aspects, the workpiece is supported by the carrier ring such that the center of the workpiece is eccentric to the center of the carrier ring, and the carrier ring is rotated around the center of the carrier ring. The above arrangement allows the support hole to move with respect to the workpiece as carrier ring is rotated, bringing the support hole into contact with the workpiece at a contact point. An end surface of the workpiece is thus pressed at the contact point to apply a rotation moment to the workpiece, since the center of the workpiece is decentered from the center of the carrier ring. The rotation moment allows the workpiece to rotate along with the carrier ring to be ground without the necessity of providing a projection to the support hole, thus preventing occurrence of nanotopography due to engagement between the notch and the projection. The grinding quality of the workpiece can thus be improved without causing the typical problems such as complication of the process and increase in costs.

In the carrier ring of the above aspect, it is preferable that an eccentricity of the center of the support hole to the center of the carrier ring is 1.7% or less of a diameter of the workpiece.

When the eccentricity exceeds 1.7% of the diameter of the workpiece, a typical grinding machine fails to bring an end of the workpiece in an eccentric direction into contact with a grinding stone, thus causing a failure in grinding.

In contrast, the above aspect can prevent such a problem, since the eccentricity is set in the above range.

BRIEF DESCRIPTION OF DRAWING(S)

DESCRIPTION OF EMBODIMENT(S)

An exemplary embodiment of the invention will be described below with reference to the attached drawings.

Arrangement of Double-Head Grinding Machine

Figure 1:
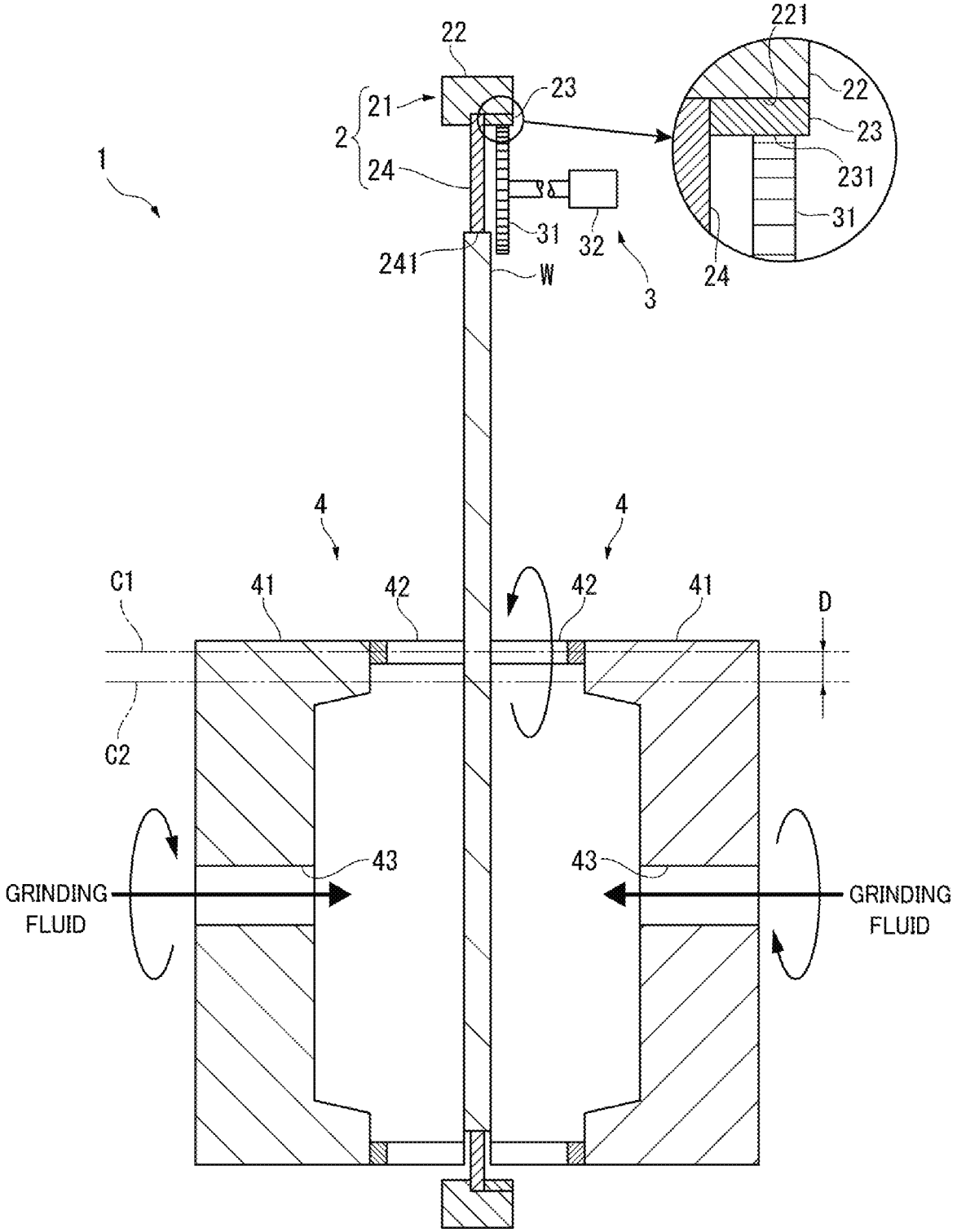
FIG. 1 is a sectional view showing a relevant part of a double-head grinding machine according to an exemplary embodiment of the invention.

As shown in FIG. 1, a double-head grinding machine 1 (grinding machine) includes a disc-shaped carrier ring 2 configured to hold a silicon wafer W (workpiece) therein, a rotation mechanism 3 configured to rotate the carrier ring 2 around a center C1 of the carrier ring 2 (i.e., rotation axis), and two grinding wheels 4 facing both surfaces of the silicon wafer W held by the carrier ring 2 and each including a plurality of grinding stones 42 for grinding the silicon wafer W.

Figure 2:
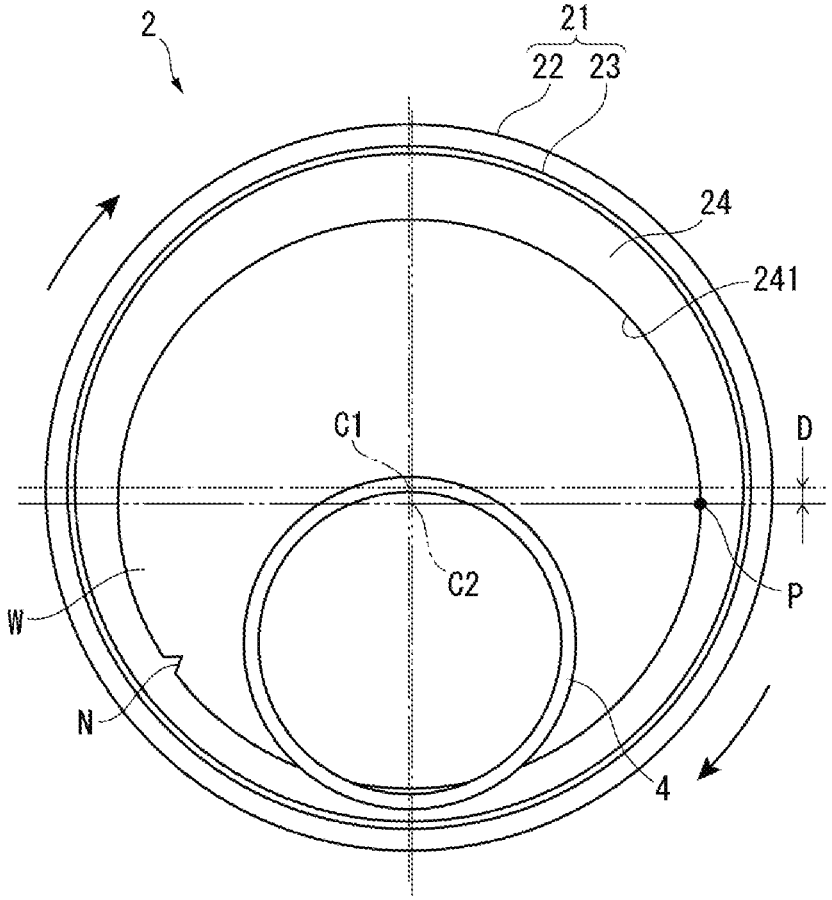
FIG. 2 is a front view showing a carrier ring according to the exemplary embodiment, which is related to Examples 1 and 2 of the invention.

As also shown in FIG. 2, the carrier ring 2 includes a rotary ring 21 in the form of an annular plate, and a support ring 24 in the form of an annular plate and having an outer periphery held by the rotary ring 21.

The rotary ring 21 includes a ring body 22 and a retaining ring 23, each of which is made of a material such as stainless steel (SUS). A fitting groove 221 is provided to an inner edge on a side of the ring body 22 to receive the outer periphery of the support ring 24 and the retaining ring 23. An inner circumferential surface of the retaining ring 23 is provided with an internal gear 231 designed to mesh with a later-described drive gear 31 of the rotation mechanism 3.

The support ring 24 is made of, for instance, glass epoxy resin and thinner than the silicon wafer W. The support ring 24 has a support hole 241 for supporting the silicon wafer W. The support hole 241 is circular and a center C2 of the support hole 241 is eccentric to the center C1 of the carrier ring 2. An eccentricity D of the center C2 of the support hole 241 to the center C1 of the carrier ring 2 is not limited but is preferably 1.7% or less of a diameter of the carrier ring 2. An inner diameter of the support hole 241 is not limited as long as it exceeds a diameter of the silicon wafer W, but is preferably different from the diameter of the silicon wafer W by 1 mm or less.

It should be noted that the support ring 24 has not projection projecting into the support hole 241 and engageable with a notch N of the silicon wafer W.

The rotation mechanism 3 includes the drive gear 31 designed to mesh with the internal gear 231 of the carrier ring 2, and a drive motor 32 for driving the drive gear 31.

The grinding wheels 4 each include a substantially disc-shaped wheel base 41, and the plurality of grinding stones 42 arranged on a surface of the wheel base 41 along an outer edge at regular intervals. The wheel base 41 is provided with a grinding fluid inlet 43 at a center thereof, the grinding fluid inlet 43 penetrating the wheel base 41 from one side to the other side. A grinding fluid is supplied into the grinding wheel 4 through the grinding fluid inlet 43.

Double-Head Grinding Method

Next, description will be made on a double-head grinding method using the double-head grinding machine 1.

As shown in FIG. 1, the silicon wafer W is ground by pressing the grinding wheels 4 onto both surfaces of the silicon wafer W set in a vertical position, and rotating the carrier ring 2 and the grinding wheels 4 while supplying the grinding fluid into the grinding wheels 4.

Since the center C2 of the support hole 241 is eccentric to the center C1 of the carrier ring 2, for instance, an anti-clockwise rotation of the carrier ring 2 as shown in FIG. 2 upon the start of the grinding causes the support hole 241 to move with respect to the silicon wafer W, bringing the support hole 241 and the silicon wafer W into contact with each other at a contact point P. An end surface of the silicon wafer W is thus pressed at the contact point P. At this time, a rotation moment is applied to the silicon wafer W, since the center of the silicon wafer W is decentered from the center C1 of the carrier ring 2. This rotation moment allows the silicon wafer W to rotate to be ground without the necessity of providing the carrier ring 2 with a projection engageable with the notch N.

Advantage(s) of Exemplary Embodiment(s)

The above exemplary embodiment provides the following advantages.

The support hole 241 of the carrier ring 2 is formed such that the center C2 of the support hole 241 is eccentric to the center C1 of the carrier ring 2.

Such an eccentric arrangement allows the silicon wafer W to rotate to be ground without the necessity of providing the carrier ring 2 with a projection engageable with the notch N as described above. Thus, occurrence of nanotopography due to engagement between the notch N and the projection can be prevented to improve the grinding quality of the silicon wafer W without causing typical problems such as complication of the process and increase in costs.

Other Exemplary Embodiment(s)

It should be noted that the machine and method are not limited to the above exemplary embodiment, but a variety of improvements or design changes compatible with the invention may be added.

For instance, the eccentricity D of the center C2 of the support hole 241 to the center C1 of the carrier ring 2 may exceed 1.7% of the diameter of the carrier ring 2.

The rotary ring 21 and the support ring 24 are exemplarily in the form of separate components made of different materials, but may be made of the same material. In the latter case, the rotary ring 21 and the support ring 24 may be in the form of separate components or in the form of a single component (carrier ring).

The workpiece may be any object with a circular contour, such as ceramics and stones, as well as the silicon wafer W.

EXAMPLE(S)

Next, the invention is described in further detail with reference to Example(s) and Comparative(s), which by no means limit the invention.

Example 1

A double-head grinding machine (manufactured by KOYO MACHINE INDUSTRIES CO., LTD., DXSG320), which is structurally similar to the double-head grinding machine 1 used in the exemplary embodiment, was prepared. The carrier ring 2 shown in FIG. 2 was also prepared. In Example 1, the support hole 241 satisfying the following conditions was formed. It should be noted that the diameter of the silicon wafer W (workpiece) was 300 mm.

Inner diameter: 301 mm or less

Eccentricity D: 2 mm (0.67% of the diameter of the silicon wafer W)

Figure 4:
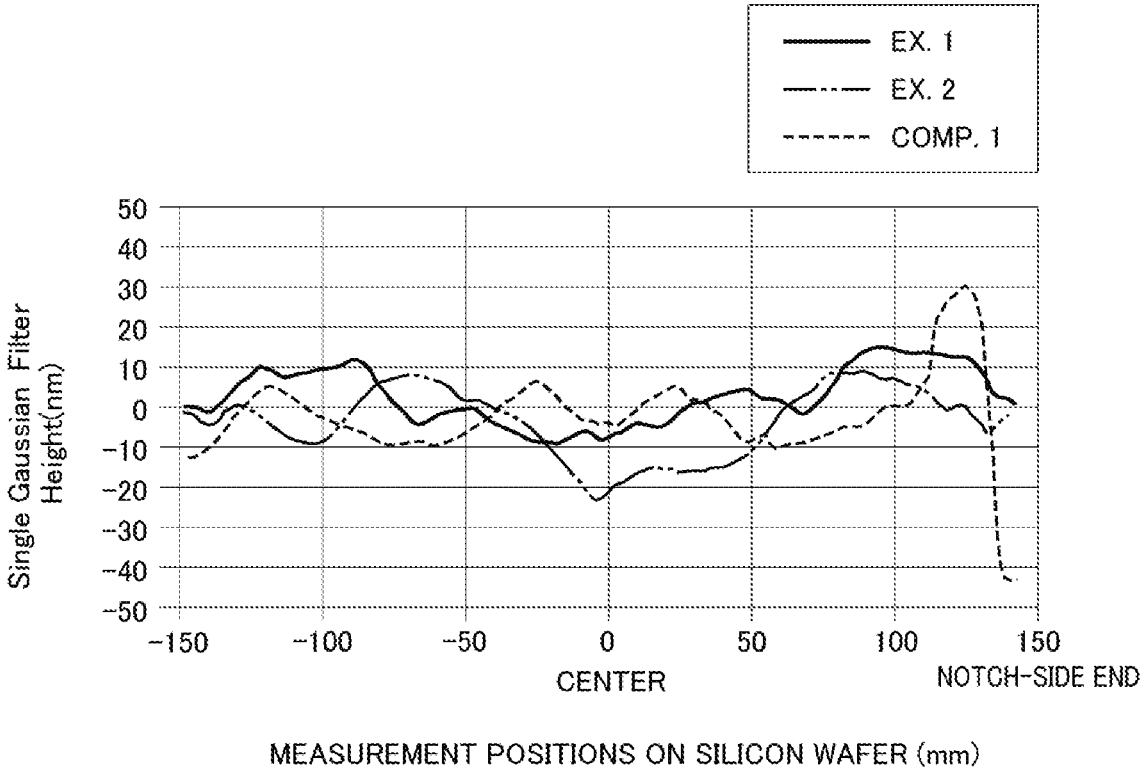
FIG. 4 is a graph showing a sectional profile of a ground silicon wafer related to each of Examples 1 and 2 and Comparative of the invention.

Both surfaces of the silicon wafer W were ground under the following conditions, and a sectional profile of the silicon wafer W including the locations of the center and the notch N was determined using a nanotopography measuring machine (manufactured by ADE Corporation, trade name: NanoMapper). FIG. 4 shows the results.

As shown in FIG. 4, single gaussian filter height (profile data) shows that no unusual pattern occurred in the silicon wafer W near the notch N and on any other spot and a PV value (an index for quality evaluation of silicon wafers) was reduced. The quality of the silicon wafer has thus proven to be good. It should be noted that the single gaussian filter height is an index for showing a waviness in a large cycle due to machining (e.g., grinding) of a silicon wafer.

Grinding Conditions

Grit of grinding stone: #2000

Diameter of grinding wheel: 160 mm

Rotation speed of grinding wheel: 4000 rpm

Rotation speed of carrier ring: 40 rpm

Example 2

The prepared carrier ring 2 was structurally the same as that of Example 1 except that the eccentricity D of the support hole 241 was 5 mm (1.67% of the diameter of the silicon wafer W). Both surfaces of the silicon wafer W of 300 mm were ground under the same conditions as in Example 1, and a sectional profile was determined. FIG. 4 shows the results.

As shown in FIG. 4, since no unusual patter occurred in the silicon wafer W near the notch N and on any other spot in the same manner as in Example 1, the quality of the silicon wafer has proven to be good.

Comparative

Figure 3:
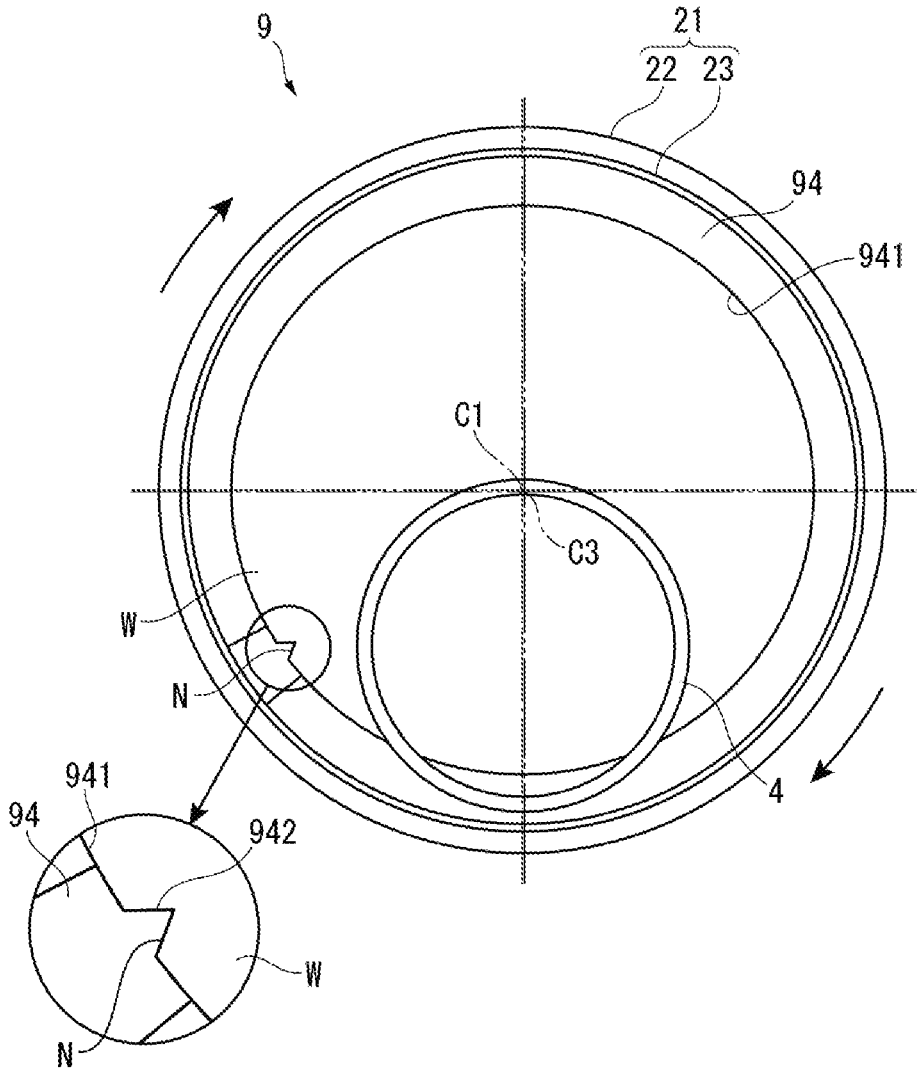
FIG. 3 is a front view showing a carrier ring related to Comparative of the invention.

A carrier ring 9 shown in FIG. 3 was prepared.

The carrier ring 9 includes the rotary ring 21 and a support ring 94. The support ring 94 has a support hole 941. The support hole 941 has a center C3, which is aligned with the center C1 of the carrier ring 2, and is in a circular shape with the same inner diameter as that of the support hole 241 of Examples 1 and 2. In other words, the eccentricity D of the support hole 941 is 0 mm. Further, the support ring 94 is provided with a projection 942 projecting into the support hole 941 and engageable with the notch N of the silicon wafer W.

The silicon wafer W of 300 mm was supported by the carrier ring 9 such that the notch N is engaged with the projection 942. Both surfaces of the silicon wafer W were then ground under the same conditions as in Example 1 and a sectional profile was determined. FIG. 4 shows the results.

As shown in FIG. 4, an unusual pattern occurred near an end besides the notch N and a PV value (an index for quality evaluation) was increased due to this unusual pattern. The quality of the silicon wafer has thus proven to be lowered as compared with those of Examples 1 and 2. The above results are supposed to imply that an excessive pressing force generated between the notch N and the projection 942 warped the silicon wafer W being ground, causing abnormal grinding.

In view of the above, it has been found that the grinding quality of the silicon wafer can be improved without causing typical problems such as complication of the process and increase in costs when the center of the support hole of the carrier ring is eccentric to the center of the carrier ring.

The invention claimed is:

1. A grinding machine configured to grind a workpiece with a circular contour and having two opposing surfaces, the grinding machine comprising:

a disc-shaped carrier ring provided with a support hole for supporting the workpiece such that the two opposing surfaces are exposed for grinding;

a rotation mechanism configured to rotate the carrier ring around a center of the carrier ring;

two grinding wheels such that one grinding wheel is disposed facing one surface of the workpiece and the other grinding wheel is disposed facing the other surface of the workpiece;

each of the two grinding wheels comprising a disc-shaped wheel base and a plurality of grinding stones for grinding the workpiece, wherein the support hole provided in a circular shape has a center eccentric to the center of the carrier ring, an eccentricity of the center of the support hole to the center of the carrier ring is greater than 0.0% and at most 1.7% of a diameter of the workpiece, a diameter of each of the wheel bases is smaller than a diameter of the support hole, and the plurality of grinding stones are arranged on a surface of each of the wheel bases along an outer edge at regular intervals.

2. A grinding method for grinding a workpiece with a circular contour, the method comprising:

supporting the workpiece in a circular-shaped support hole provided to a disc-shaped carrier ring such that a center of the workpiece is eccentric to a center of the carrier ring;

rotating the carrier ring around the center of the carrier ring; and grinding the workpiece by pressing two grinding wheels against both surfaces of the workpiece while rotating the grinding wheels, the grinding wheels facing the respective surfaces of the workpiece held by the carrier ring, wherein an eccentricity of the center of the support hole to the center of the carrier ring is greater than 0.0% and at most 1.7% of a diameter of the workpiece, the grinding wheels each comprise a disc-shaped wheel base and a plurality of grinding stones arranged on a surface of each of the wheel bases along an outer edge at regular intervals, and a diameter of each wheel base is smaller than a diameter of the support hole.

* * * * *